US007306517B1

(12) United States Patent
Forbes

(10) Patent No.: US 7,306,517 B1
(45) Date of Patent: Dec. 11, 2007

(54) WAGERING GAMING AND METHOD OF PLAY

(75) Inventor: Jack Forbes, Las Vegas, NV (US)

(73) Assignee: Creative Gaming Concepts, Inc., Las Vegas, NV (US)

( * ) Notice: Subject to any disclaimer, the term of this patent is extended or adjusted under 35 U.S.C. 154(b) by 817 days.

(21) Appl. No.: 10/840,142

(22) Filed: May 6, 2004

Related U.S. Application Data

(63) Continuation-in-part of application No. 10/649,846, filed on Aug. 26, 2003.

(51) Int. Cl.
*A65F 1/00* (2006.01)

(52) U.S. Cl. ..... 463/13; 463/11; 463/20

(58) Field of Classification Search ..... 463/13
See application file for complete search history.

(56) References Cited

U.S. PATENT DOCUMENTS

| | | | | |
|---|---|---|---|---|
| 3,876,208 | A | 4/1975 | Wächtler et al. | |
| 5,033,744 | A * | 7/1991 | Bridgeman et al. | 463/13 |
| 5,098,107 | A | 3/1992 | Boylan et al. | |
| 5,332,219 | A * | 7/1994 | Marnell et al. | 463/13 |
| 5,845,906 | A | 12/1998 | Wirth | |
| 5,947,821 | A | 9/1999 | Stone | |
| 6,062,980 | A * | 5/2000 | Luciano | 463/20 |
| 6,070,873 | A | 6/2000 | Perkins | |
| 6,102,799 | A | 8/2000 | Stupak | |
| 6,113,101 | A | 9/2000 | Wirth | |
| 6,227,969 | B1 * | 5/2001 | Yoseloff | 463/13 |
| 6,234,485 | B1 | 5/2001 | Perkins | |
| 6,342,007 | B1 * | 1/2002 | Wood et al. | 463/13 |
| 6,468,156 | B1 | 10/2002 | Hughs-Baird et al. | |
| 2002/0190469 | A1 | 12/2002 | Conklin et al. | |
| 2004/0009810 | A1 | 1/2004 | Moody | |
| 2004/0017043 | A1 | 1/2004 | Moody | |

* cited by examiner

*Primary Examiner*—Xuan M. Thai
*Assistant Examiner*—Joshua P. Wert
(74) *Attorney, Agent, or Firm*—Rob Phillips; Greenberg Traurig

(57) ABSTRACT

A game enhances conventional video poker by providing players an enhanced opportunity to hit four of a kind. Ideally, players are provided an option to place a wager once five initial cards are displayed. The option is provided in response to the five dealt cards including one or more pairs. Should the player elect to place the wager, the player must retain one pair and a kicker. The player is then provided with a fourth card having a rank the same as the rank of the pair. The player now holds three of a kind and a kicker. Finally, a fifth and final card is displayed. If the player obtains a four of a kind, the player receives a payout. Other versions include a progressive jackpot and the option to buy cards.

37 Claims, 13 Drawing Sheets

300

| | DEALT THREE CARDS INITIALLY TO THE ROYAL (i.e., PROVIDED ONE REPLACEMENT ROYAL FLUSH CARD) | DEALT TWO CARDS INITIALLY TO THE ROYAL (i.e., PROVIDED TWO REPLACEMENT ROYAL FLUSH CARDS) | DEALT ONE CARD INITIALLY TO THE ROYAL (i.e., PROVIDED THREE REPLACEMENT ROYAL FLUSH CARDS) |
|---|---|---|---|
| ODDS<br>PAYOUT<br>HOUSE EDGE | 44:1<br>44 FOR 1<br>2.22% | 45:1<br>45 FOR 1<br>2.17% | 46:1<br>46 FOR 1<br>2.13% |
| PAYOUT<br>HOUSE EDGE | 43 FOR 1<br>4.44% | 44 FOR 1<br>4.35% | 45 FOR 1<br>4.26% |
| PAYOUT<br>HOUSE EDGE | 42 FOR 1<br>6.67% | 43 FOR 1<br>6.52% | 44 FOR 1<br>6.38% |

FIG. 4

800

810 830

| ADDITIONAL UNITS WAGERED | FOUR OF A KIND PAYOUT |
|---|---|
| 0 | 63 FOR 1 |
| 1 | 107 FOR 1 |
| 2 | 151 FOR 1 |
| 3 | 195 FOR 1 |
| 4 | 239 FOR 1 |
| 5 | 283 OFR 1 |
| 6 | 327 FOR 1 |
| 7 | 371 FOR 1 |
| 8 | 415 FOR 1 |

840

820

FIG. 9A

850

870 860 880 895

| ADDITIONAL UNITS WAGERED | FOUR OF A KIND | PROGRESSIVE |
|---|---|---|
| 0 | 56 FOR 1 | NO |
| 1 | 99 FOR 1 | NO |
| 2 | 142 FOR 1 | NO |
| 3 | 185 FOR 1 | NO |
| 4 | 228 FOR 1 | NO |
| 5 | 271 OFR 1 | NO |
| 6 | 314 FOR 1 | NO |
| 7 | 357 FOR 1 | NO |
| 8 | 400 FOR 1 | NO |
| 9 | 400 FOR 1 | YES |

890

FIG. 9B

| | 1 | 2 | 3 | 4 | 5 |
|---|---|---|---|---|---|
| ROYAL FLUSH | 800 | 1600 | 2400 | 3200 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIRS | 2 | 4 | 6 | 8 | 10 |
| JACKS OR BETTER | 1 | 2 | 3 | 4 | 5 |

FIG. 11

| | 1 | 2 | 3 | 4 | 5 |
|---|---|---|---|---|---|
| ROYAL FLUSH | 800 | 1600 | 2400 | 3200 | 4000 |
| STRAIGHT FLUSH | 50 | 100 | 150 | 200 | 250 |
| FOUR ACES | 80 | 160 | 240 | 320 | 400 |
| FOUR 2'S - 4'S | 40 | 80 | 120 | 160 | 240 |
| FOUR 5'S - K'S | 25 | 50 | 75 | 100 | 125 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| 3 OF A KIND | 3 | 6 | 9 | 12 | 15 |
| 2 PAIR | 2 | 4 | 6 | 8 | 10 |
| JACKS OR BETTER | 1 | 2 | 3 | 4 | 5 |

FIG. 12

| | 1 | 2 | 3 | 4 | 5 |
|---|---|---|---|---|---|
| ROYAL FLUSH | 800 | 1600 | 2400 | 3200 | 4000 |
| STRAIGHT FLUSH | 50 | 100 | 150 | 200 | 250 |
| FOUR ACES | 400 | 800 | 1200 | 1600 | 2000 |
| FOUR 2'S - 4'S | 40 | 80 | 120 | 160 | 240 |
| FOUR 5'S - K'S | 25 | 50 | 75 | 100 | 125 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| 3 OF A KIND | 3 | 6 | 9 | 12 | 15 |
| 2 PAIR | 2 | 4 | 6 | 8 | 10 |
| JACKS OR BETTER | 1 | 2 | 3 | 4 | 5 |

FIG. 13

| | 1 | 2 | 3 | 4 | 5 |
|---|---|---|---|---|---|
| ROYAL FLUSH | 1600 | 3200 | 4800 | 6400 | 8000 |
| STRAIGHT FLUSH | 50 | 100 | 150 | 200 | 250 |
| FOUR ACES | 320 | 640 | 960 | 1280 | 1600 |
| FOUR 2'S - 4'S | 40 | 80 | 120 | 160 | 240 |
| FOUR 5'S - K'S | 25 | 50 | 75 | 100 | 125 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| 3 OF A KIND | 3 | 6 | 9 | 12 | 15 |
| 2 PAIR | 2 | 4 | 6 | 8 | 10 |
| JACKS OR BETTER | 1 | 2 | 3 | 4 | 5 |

FIG. 14

| | 1 | 2 | 3 | 4 | 5 |
|---|---|---|---|---|---|
| ROYAL FLUSH | 800 | 1600 | 2400 | 3200 | 4000 |
| STRAIGHT FLUSH | 50 | 100 | 150 | 200 | 250 |
| FOUR ACES | 100 | 200 | 300 | 400 | 500 |
| FOUR 2'S - K'S W/ ACE KICKER | 100 | 200 | 300 | 400 | 500 |
| FOUR 2'S - K'S W/ NON-ACE KICKER | 25 | 50 | 75 | 100 | 125 |
| FULL HOUSE | 6 | 12 | 18 | 24 | 30 |
| FLUSH | 5 | 10 | 15 | 20 | 25 |
| STRAIGHT | 4 | 8 | 12 | 16 | 20 |
| 3 OF A KIND | 3 | 6 | 9 | 12 | 15 |
| 2 PAIR | 2 | 4 | 6 | 8 | 10 |
| JACKS OR BETTER | 1 | 2 | 3 | 4 | 5 |

FIG. 15

| | 1 | 2 | 3 | 4 | 5 |
|---|---|---|---|---|---|
| ROYAL FLUSH | 800 | 1600 | 2400 | 3200 | 4000 |
| STRAIGHT FLUSH | 50 | 100 | 150 | 200 | 250 |
| FOUR ACES | 400 | 800 | 1200 | 1600 | 2000 |
| FOUR 2'S - K'S W/ ACE KICKER | 400 | 800 | 1200 | 1600 | 2000 |
| FOUR 2'S - K'S W/ NON-ACE KICKER | 50 | 100 | 150 | 200 | 250 |
| FULL HOUSE | 18 | 36 | 54 | 72 | 90 |
| FLUSH | 14 | 28 | 42 | 56 | 70 |
| STRAIGHT | 10 | 20 | 30 | 40 | 50 |
| 3 OF A KIND | 3 | 6 | 9 | 12 | 15 |
| 2 PAIR | 2 | 4 | 6 | 8 | 10 |
| JACKS OR BETTER | 1 | 2 | 3 | 4 | 5 |

FIG. 16

| | 1 | 2 | 3 | 4 | 5 |
|---|---|---|---|---|---|
| ROYAL FLUSH | 800 | 1600 | 2400 | 3200 | 4000 |
| STRAIGHT FLUSH | 50 | 100 | 150 | 200 | 250 |
| FOUR ACES | 400 | 800 | 1200 | 1600 | 2000 |
| FOUR 2'S - K'S W/ ACE KICKER | 400 | 800 | 1200 | 1600 | 2000 |
| FULL HOUSE | 20 | 40 | 60 | 80 | 100 |
| FLUSH | 15 | 30 | 45 | 60 | 75 |
| STRAIGHT | 12 | 24 | 36 | 48 | 60 |
| 3 OF A KIND | 3 | 6 | 9 | 12 | 15 |
| 2 PAIR | 2 | 4 | 6 | 8 | 10 |
| JACKS OR BETTER | 1 | 2 | 3 | 4 | 5 |

FIG. 17

WAGERING GAMING AND METHOD OF PLAY

CROSS REFERENCE TO RELATED APPLICATIONS

This application is a continuation-in-part of application Ser. No. 10/649,846 filed Aug. 26, 2003.

FIELD OF INVENTION

The embodiments of the present invention relate generally to casino wagering. More particularly, a poker based wagering game particularly particular suitable for implementation in a gaming device is disclosed herein.

BACKGROUND

Slot machines, video poker machines, keno machines and other electronic gaming devices have seized the majority of casino floor space. Besides being attractive to players, electronic gaming devices are attractive to casinos as they generate substantial revenue and facilitate easy accounting procedures. One overwhelmingly popular wagering game which is implemented in an electronic gaming device is video poker.

The success of video poker is based on many attributes, including ease and speed of play and its large payback parameters (e.g., 93% to 100%). Video poker is generally played as follows: A player first places a wager and then causes the video poker machine to reveal five randomly simulated playing cards from a standard 52-card deck of playing cards. The player is then able to discard any number (i.e., 0-5) of the five cards initially displayed. Then, once the player has selected which cards to hold and discard, the video poker machine randomly replaces the discards with cards remaining in the deck. Based on the poker ranking of the final five cards, the player either loses the wager or is awarded a payout. The amount of the payout increases as a function of the poker ranking as depicted in a pay table of the respective machine. Thus, a straight may pay 20 coins and a full house may pay 45 coins. The highest hand achievable is the "Royal Flush", which typically pays out 4000 coins on a maximum bet placed on a five coin maximum bet machine.

Many video poker machines allow players to play from 1 to 5 coins. Video poker machines pay out winning hands on a relatively linear relationship to the number of coins played. In other words, with one coin played, a straight may pay out 4 coins, with two coins played the straight may pay out 8 coins, with three coins played the straight may pay out 12 coins, with four coins played the straight may pay out 16 coins and finally with five coins played the straight may pay out 20 coins. However, the payout for a royal flush is increased in a non-linear fashion when five coins are played. Thus, although the linear payout should be 1250 coins for 5 coins played, the payout is typically 4000 coins. Increased payouts encourage players to pursue the royal flush over other possible winning combinations, which favors a casino's bottom line. However, the mathematical probability of a player being dealt a royal flush or drawing a royal flush is approximately 43,000 to one. Therefore, assuming an average player who plays five hands per minute or 300 hands per hour, it would theoretically take 143 hours to hit the royal flush. Playing four hours a day, every day, will compel a player to play over 35 days to hit the royal flush. Of course theoretical and actual play time may vary. Most players, and certainly tourist, do not have the time nor the desire to dedicate such time to hitting the royal flush.

Certain new variations to video poker have reduced the amount of time it takes to hit a royal flush. For example, a game known as TRIPLE PLAY POKER® allows players to play hold cards from a first hand in three separate simultaneously played hands. Thus, three hands can be played in the time it takes to play one hand on a conventional video poker machine. In addition, TRIPLE PLAY POKER® has been augmented to ten, fifty and even one hundred simultaneously played hands. Such an increase in the number of played hands, has naturally reduced the time needed to hit a royal flush. Unfortunately, even with the aforementioned variations, casual players still rarely hit the royal flush. Moreover, in theory, it still costs the same amount of money to hit the royal flush under any of the previous examples.

Regardless of the probability of hitting the royal flush, certain players are known to hit more than their mathematical share of royal flushes. In fact, players talk about the number of royal flushes they have hit with great pride. Normally, the particular video poker game which provided the royal flush is not important to the prideful victor. Therefore, any means for improving the probability of hitting royal flushes is important to such competitors.

Thus, there is a need for a poker based wagering game which provides players with a more realistic opportunity to hit royal flushes with some degree of frequency.

SUMMARY

Accordingly, the embodiments of the present invention are first facilitated by an electronic gaming machine. For example, in a video poker machine which accepts 1 to 5 coins as a wager, a player makes his wager and once the coins are wagered, the gaming machine causes five randomly selected cards to be displayed on a gaming machine video display. Unlike conventional video poker, the player is then provided with an opportunity to dramatically increase (i.e., on a scale of one thousand) the probability of hitting a royal flush.

The opportunity arises in response to a player holding one or more (e.g., up to three) initial cards to the royal flush sequence. That is, the ten, jack, queen, king or ace of the same suit. If any one of the cards common to the royal flush should be displayed and the player holds the card or cards common to the royal flush, the player can opt to replace the remaining non-hold cards with royal flush cards such that the player will, upon completion, and prior to receiving a final draw card, be holding four to the royal flush sequence. The option requires the player to place a second wager. This option becomes available when one, two or three cards to the royal flush are held initially by the player. Alternatively, the player may only be permitted to replace a number of non-hold cards such that the player holds three or even two cards to a royal flush. Pursuant to such an alternative embodiment, the odds afforded the player are increased.

By providing a number of the missing royal flush sequence cards the royal flush is now possible with an extremely attractive frequency. In fact, the probability of drawing a royal flush after the second wager and with the player now holding four cards to the royal flush ranges from 44 to 1 to 46 to 1 rather than 43,000+ to one. This means the payouts can be greater than 40 to 1 on the wager.

Accordingly, the embodiments of the present invention provide an opportunity for players to hit the royal flush with more frequency. The benefits of the heretofore generally described game are explored in more detail below.

BRIEF DESCRIPTION OF THE DRAWINGS

FIG. 4 shows a table of probabilities, corresponding possible payouts and house edges;

FIG. 9*a* shows a sample pay table corresponding to the high pair embodiment;

FIG. 9*b* shows a sample pay table corresponding to the high pair embodiment including a progressive jackpot;

FIG. 11 shows a conventional video poker pay table;

FIG. 12 shows a first potential pay table corresponding to a first embodiment of an Ace in the Hold concept;

FIG. 13 shows a second potential pay table corresponding to the first embodiment of the Ace in the Hold concept;

FIG. 14 shows a third potential pay table corresponding to the first embodiment of the Ace in the Hold concept;

FIG. 15 shows a conventional video poker pay table having different four of a kind payouts;

FIG. 16 shows a first potential pay table corresponding to a second embodiment of the Ace in the Hold concept; and FIG. 17 shows a second potential pay table corresponding to the second embodiment of the Ace in the Hole concept.

DETAILED DESCRIPTION

The operation of electronic gaming machines, including slot machines and video poker machines, is well known in the industry so that the minute details are not set forth herein. In general terms, slot machines and video poker machines are controlled by processors including, or in communication with, a random number generator. The random number generator generates the machines' outcomes. A display in communication with the processor provides visual information to players.

Figure 1:
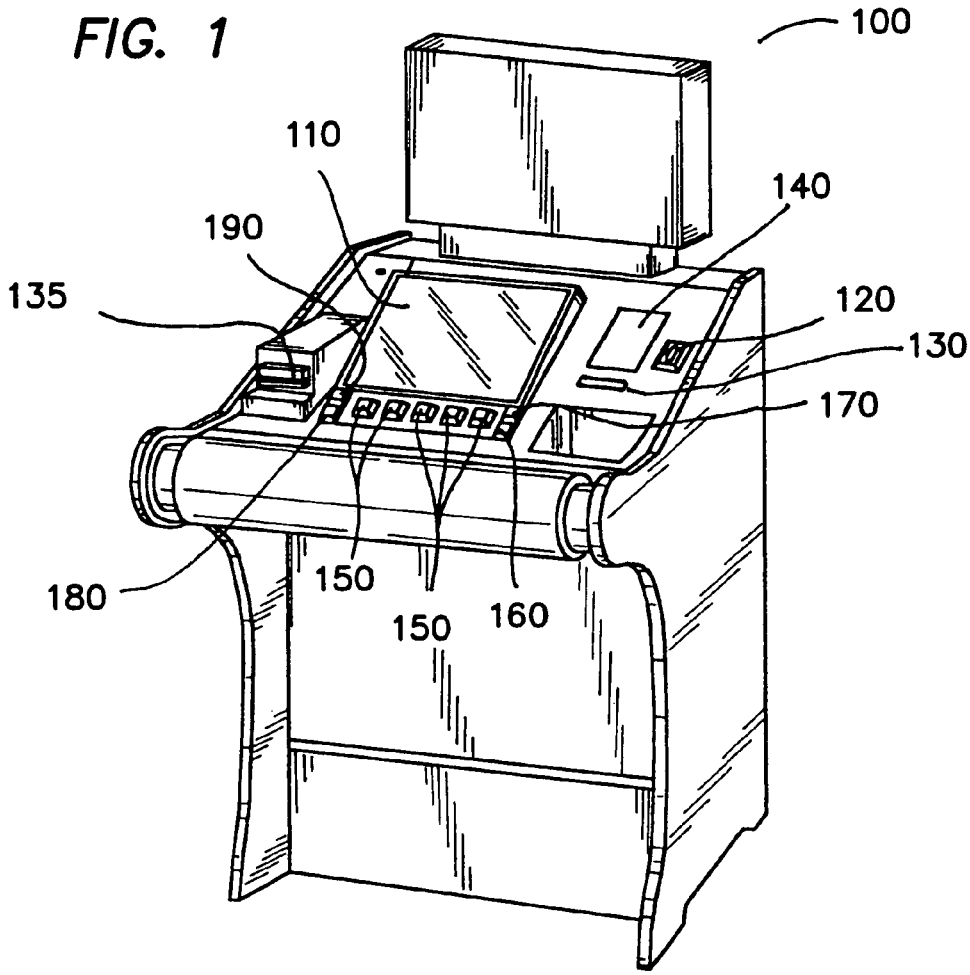
FIG. 1 shows a gaming machine for facilitating the embodiments of the present invention.

Reference is now made to the figures wherein like parts are referred to by like numerals throughout. FIG. 1 illustrates a perspective view of an electronic gaming machine for facilitating the embodiments of the present invention and is generally denoted by reference numeral 100. The general external features of the gaming machine 100, include a display 110, coin slot 120, a bill reader 130, a card reader 135 and a credit display 140. The gaming machine 100 also includes several player buttons which act as interfaces between the player and the machine processor. Player buttons include hold/discard buttons 150, a one coin wager button 160, a maximum coin wager button 170, a deal button 180 and a second wager button 190. While not shown, the machine 100 may also incorporate a ticket dispenser for printing tickets for redemption at a cashier window. Such cashless systems are becoming increasingly popular in most gaming jurisdictions. It is noted that any of the functions facilitated by the gaming machine buttons 150-190 can be accomplished by a display employing touchscreen technology.

Figure 2A:
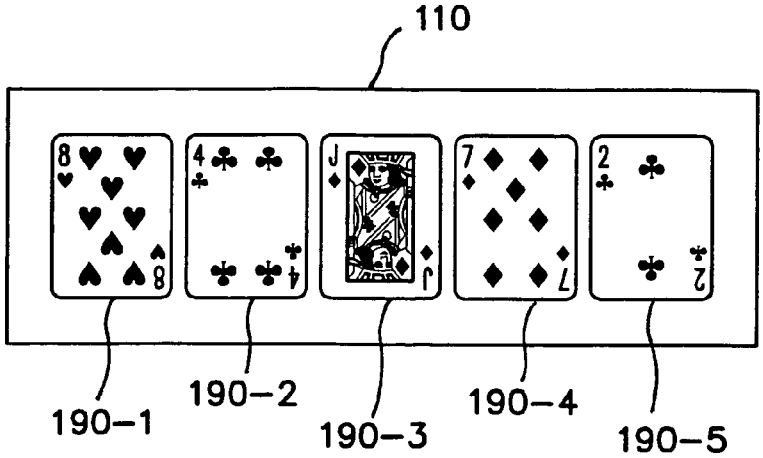
FIG. 2A shows an initial hand having one card to a royal flush.

Now referring to FIG. 2A, the display 110 is shown displaying five initial cards 190-1 through 190-5. The cards 190-1 through 190-5 are displayed once the player has placed an initial wager less than the maximum coin wager or used the one coin wager button 160 and pressed the deal button 180. Alternatively, the player may use the maximum coin wager button 170 which automatically causes the machine 100 to deal the initial five cards. Ideally, to participate in the embodiments of the present invention the player must play the maximum number of coins offered. However, it is not mandatory that the maximum number of coins be played as long as the game's payouts are adjusted accordingly. As illustrated, one card 190-3 is a royal flush card, namely the jack of diamonds. Should the player elect to hold the royal flush card 190-3 by means of the hold/discard buttons 150 or a touchscreen display, the player is provided the option of increasing the odds of receiving a royal flush in return for a second wager.

Anytime a player receives and holds one to three cards to a common royal flush, the gaming machine 100 may cause the display 110 to display a player inquiry such as "PLACE SECOND WAGER?" or something similar to alert the player that, based on his or her selected hold cards, the player has the option to place a second wager in return for receiving one to three cards to the royal flush. If the player does desire to place the second wager, he or she can use the second wager button 190 to instruct the gaming machine 100 to deduct a specific second wager amount from a credit amount depicted on credit display 140. Alternatively and additionally, the player may also insert additional money into the gaming machine 100 using known methods as described above. Once the inserted money has been recorded, the second wager button 190 may be used to deduct the specific wager amount desired.

Figure 2B:
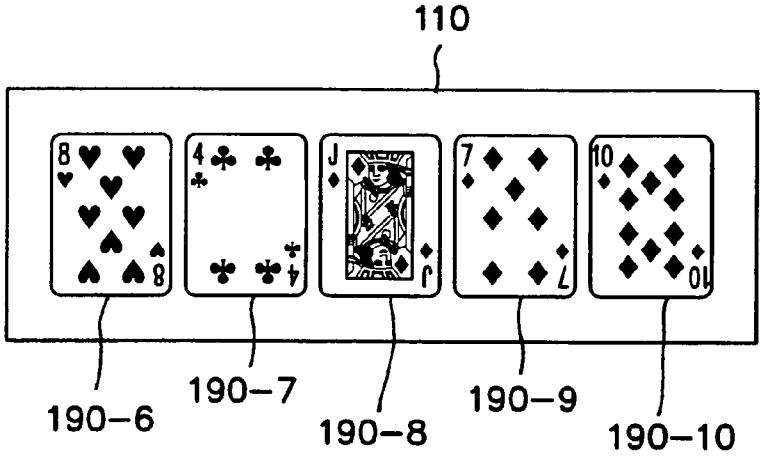
FIG. 2B shows an initial hand having two cards to a royal flush.
Figure 2C:
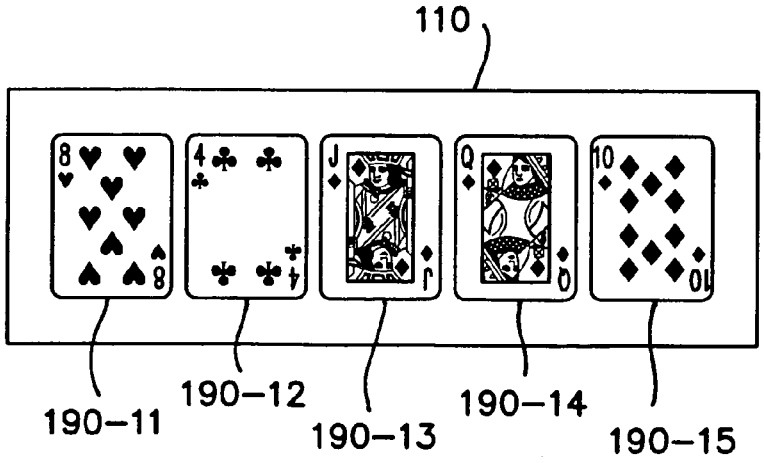
FIG. 2C shows an initial hand having three cards to a royal flush.

FIGS. 2B and 2C show other initial five card hands which have two and three cards, respectively, to a royal flush. In FIG. 2B, five cards 190-6 through 190-10 include two royal flush cards 190-8 and 190-10. In FIG. 2C, five cards 190-11 through 190-15 include three royal flush cards 190-13, 190-14 and 190-15. In either exemplary display, should the player elect to hold the royal flush cards, the gaming machine 100 automatically causes the display of the player inquiry noted above. Should the player then opt to place the second wager, a number of the non-hold cards are replaced such that the player is one card from a royal flush or four cards to a royal flush. As set forth below, and shown in FIG. 4, the odds and payouts are slightly altered depending on the number of royal flush cards displayed initially.

Figure 3:
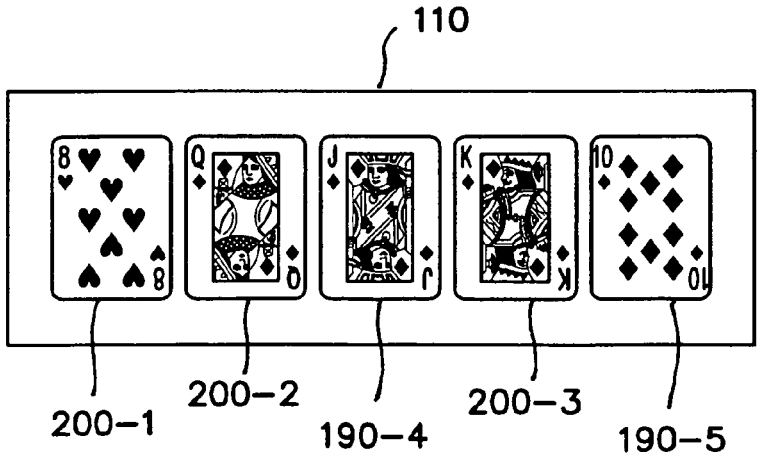
FIG. 3 shows the initial hand of FIG. 2A once the player has opted to place the second wager.

FIG. 3 shows the display 110, of FIG. 2A, once the player has opted to place the second wager and the gaming machine 100 has replaced three of the non-royal flush cards 190-1, 190-2 and 190-4 with three royal flush cards 200-1, 220-2 and 200-3 to the royal flush. By automatically replacing the non-royal flush cards 190-1, 190-2 and 190-4 with the ten of diamonds 200-1, queen of diamonds 200-2 and king of diamonds 200-3 the probability of receiving the royal flush is enhanced greatly. In fact, the player needs only the ace of diamonds to complete the royal flush.

A table 300 of possible payouts are set forth in FIG. 4. The pay table 300 shows the probabilities, possible payouts and corresponding house edge arranged according to the number of cards to the royal flush displayed initially. The payouts are exemplary and will be determined ultimately by the casino offering the embodiments of the present invention. Similarly, permitted amounts of the second wager will be determined ultimately by the casino.

In one embodiment, the royal flush is the only hand eligible for a payout once the second wager has been placed. Alternatively, however, there may also be payouts associated with receiving certain cards which do not complete the royal flush. For example, a player may be eligible for a payout if the player receives another diamond to form a flush, an ace (not a diamond suit) to form a straight or another jack, queen or king to form a high pair. The payouts (not shown) will be modest to reflect the high probability of such an occurrence.

Figure 5:
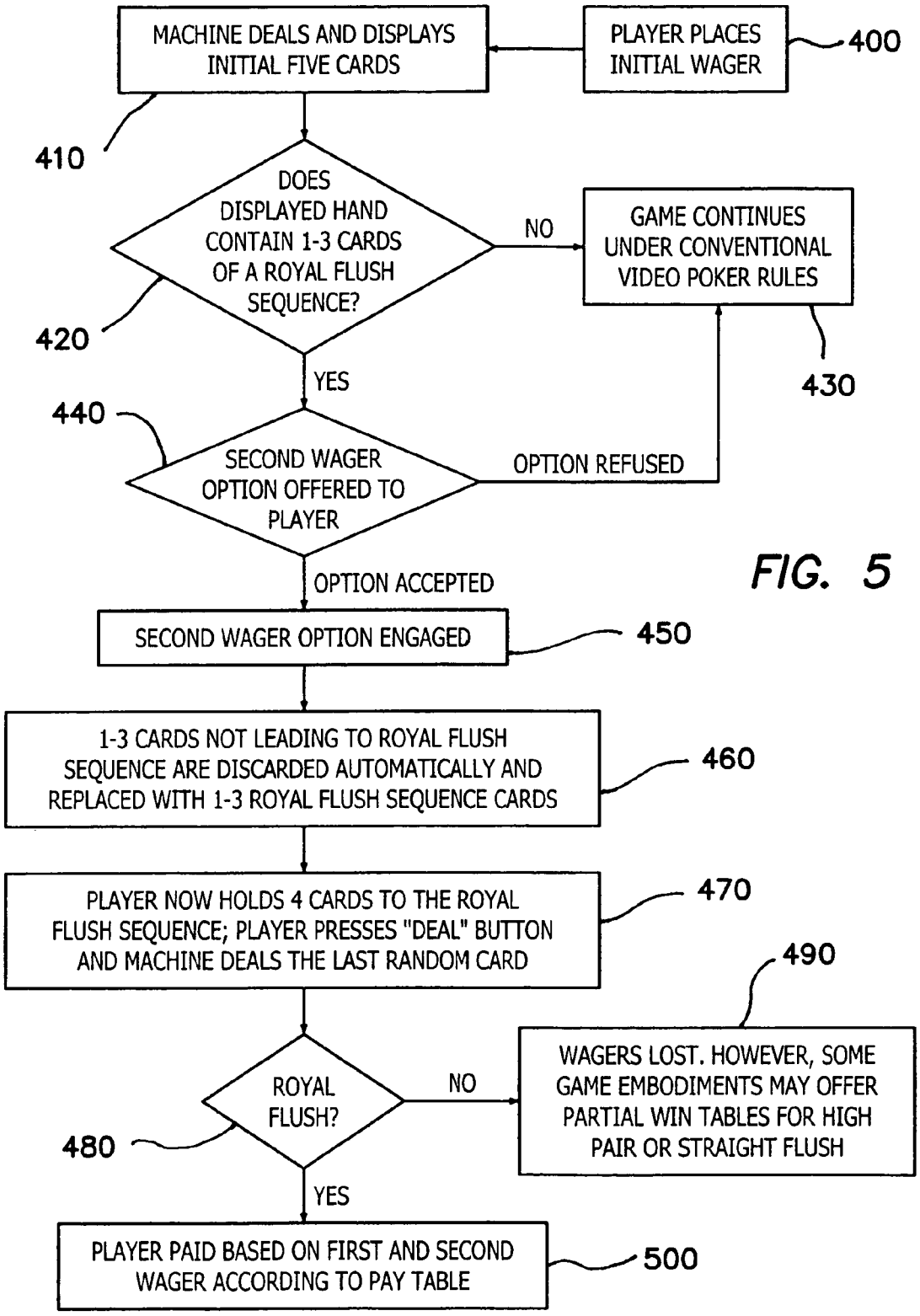
FIG. 5 shows a flow chart of a sample play of one embodiment of the present invention.

To clearly describe one embodiment of the present invention, FIG. 5 shows a flow chart outlining a sample play. At step 400 the player places an initial wager. At step 410, the gaming machine displays the initial five cards. At step 420, the player determines whether he has been dealt any cards to a royal flush sequence. At step 430 if no cards to the royal flush sequence have been dealt, the game continues according to the rules of conventional video poker. At step 440, if one, two or three of the cards to a royal flush have been dealt, the machine displays a player inquiry "Place Second Wager?" If the "Second Wager" option is refused, the game continues, at step 430, according to the rules of conventional video poker. If the player opts to place the "Second Wager", the wager amount is entered at step 450. The wager may be debited from a player's credit or may be in the form of additional cash inserted into the machine. Then, at step 460, one to three of the non-royal flush sequence cards are replaced with royal flush sequence cards so that the player is now one card away from the royal flush. In other words, the player is holding four cards to the royal flush sequence. At step 470 the player hits the deal button and the machine deals the randomly selected last card of the five card sequence. At step 480, the machine determines if a royal flush is displayed. At step 490 if there is no winning poker hand, the player loses his wagers. At step 500 if there is a royal flush displayed, the player is paid an award calculated by multiplying the amount of the second wager by the pay table odds. Under the alternative embodiment described above, other final poker hands may correspond to a modest payout.

Many variations of the above-described wagering game are possible without departing from the spirit and scope of the present invention. For example, players may only be provided with a number of replacement cards to form a hand with two or three cards to a royal flush. Such embodiments increase the payouts significantly while still facilitating more frequent royal flushes.

In an alternative embodiment, in response to receiving, and electing to hold, a pair, the player is provided the option to place an additional wager (i.e., buy the card) to receive the third card of equal rank to the rank of the pair. To participate, the player must also hold one additional card (i.e., kicker) dealt with the pair. Then, holding four cards, the player receives a fifth and final card in an effort to obtain a four of a kind.

Figure 6A:
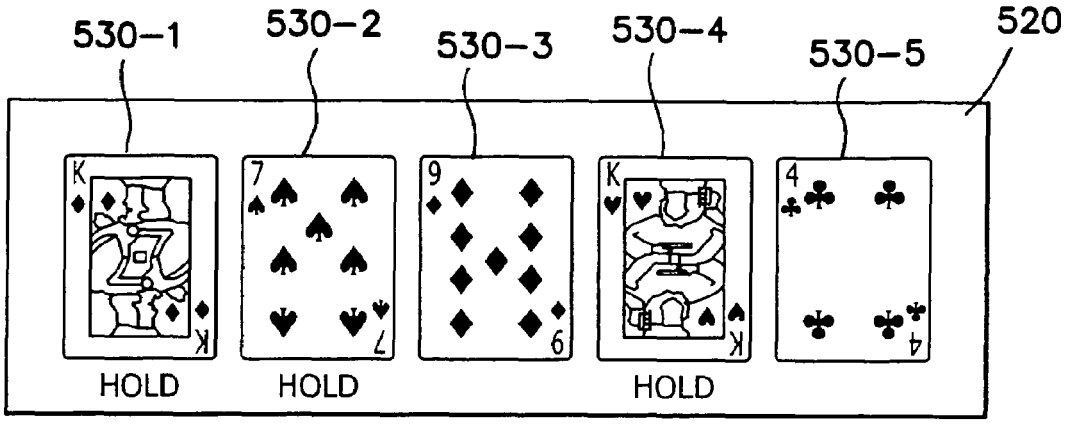
FIG. 6*a* shows a display screen depicting a sample hand of a high pair embodiment of the present invention.
Figure 6B:
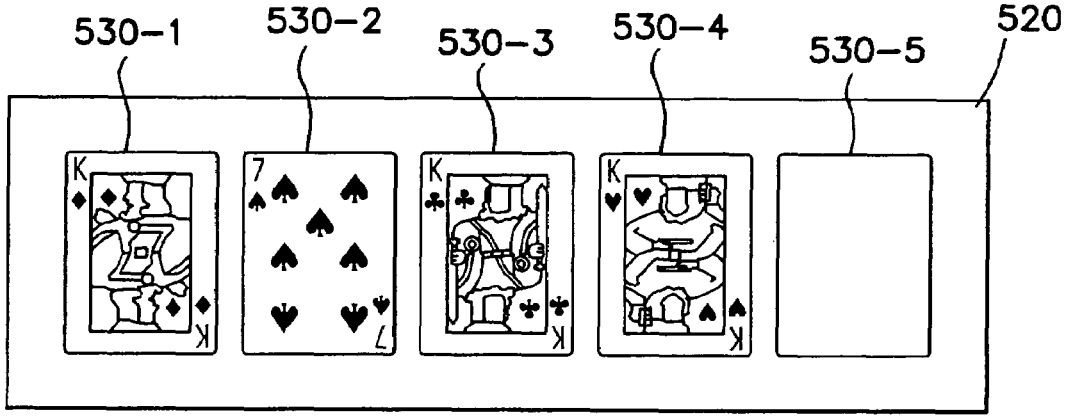
FIG. 6*b* shows the display screen subsequent to a player electing to participate in the high pair embodiment.
Figure 6C:
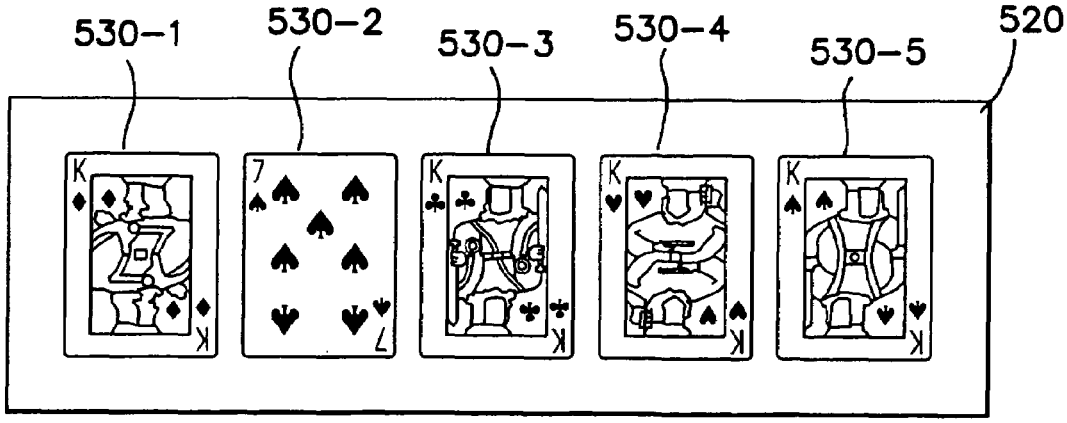
FIG. 6*c* shows the display screen once the game has been completed.

Ideally, in order to participate in the game, the held pair must comprise Jacks, Queens, Kings or Aces. FIG. 6*a* is a display screen 520 showing five initial cards 530-1 through 530-5. The five cards include a pair of Kings 530-1 and 530-4. Therefore, based on the pair of Kings, the player is provided the option to participate in the high pair embodiment of the present invention. The player is notified of the option via an inquiry on the display screen 520. Upon opting to participate, the player must hold the pair of Kings 530-1 and 530-4 and a kicker. In this case, the player has elected to hold the seven of spades 530-2 as a kicker. The player may then place an additional wager of 1 to 9 times an original wager (i.e., buying a card). Once the pair and kicker are held and an additional wager, if any is placed, the gaming device automatically displays a fourth card having the same rank as the rank of the held pair. Therefore, as shown in FIG. 6*b*, the player has been provided with the third King 530-3 and now holds three Kings and a kicker. Next, the player causes the gaming device to randomly display the fifth and final card. In this case, as shown in FIG. 6*c*, the player obtained the fourth King 530-5 thereby entitling the player to a payout as set forth in a corresponding pay table (example shown in FIGS. 9*a* and 9*b*). Optionally, the player may also be entitled to a payout for receiving a fifth card which gives the player a full house.

Figure 7:
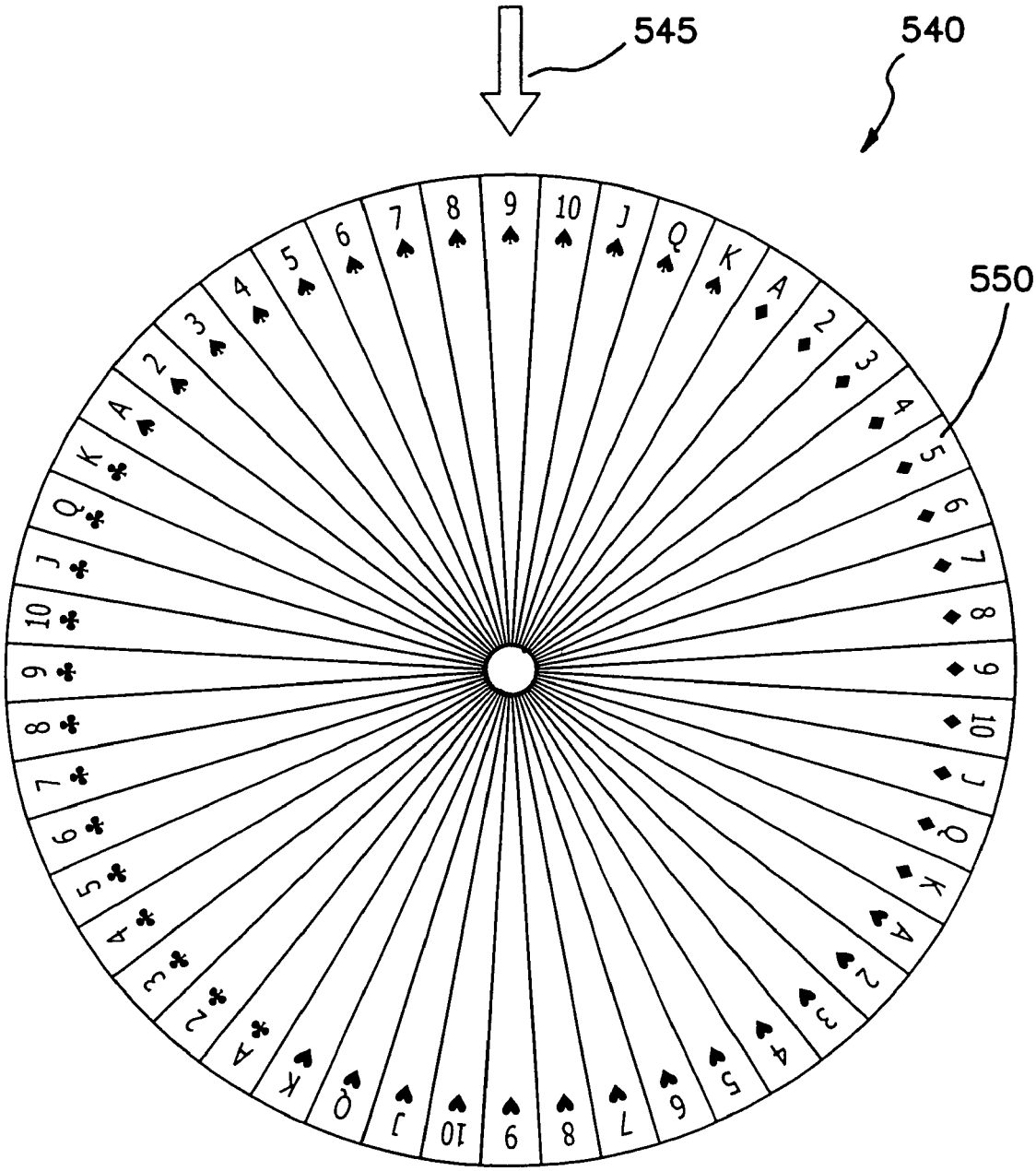
FIG. 7 shows a jackpot wheel for use with the high pair embodiment.

In a jackpot embodiment, a displayed card wheel 540 (shown in FIG. 7), having fifty-two segments 550 depicting each card in a standard deck of playing cards, facilitates a progressive jackpot. In a first embodiment, the wheel 540 is activated in concert with the random drawing of the fifth and final card. If the player obtains the four of a kind and the spinning wheel 540 stops on the segment 550 depicting the rank and suit of the held kicker, the player wins the progressive jackpot. Optionally, the player may also win a smaller award if the wheel 540 stops on the segment 550 depicting the kicker but the player fails to obtain the four of a kind. The card rank and suit may also be randomly displayed on the display 520 without the necessity of the wheel 540. For example, a random single card may be instantaneously displayed in a corner of the display 520, a grid of cards may show one randomly selected card highlighted or any number of other entertaining formats may be utilized to show the randomly selected card rank and suit. By selecting the kicker, the player is partially deciding the outcome of the jackpot.

Figure 8:
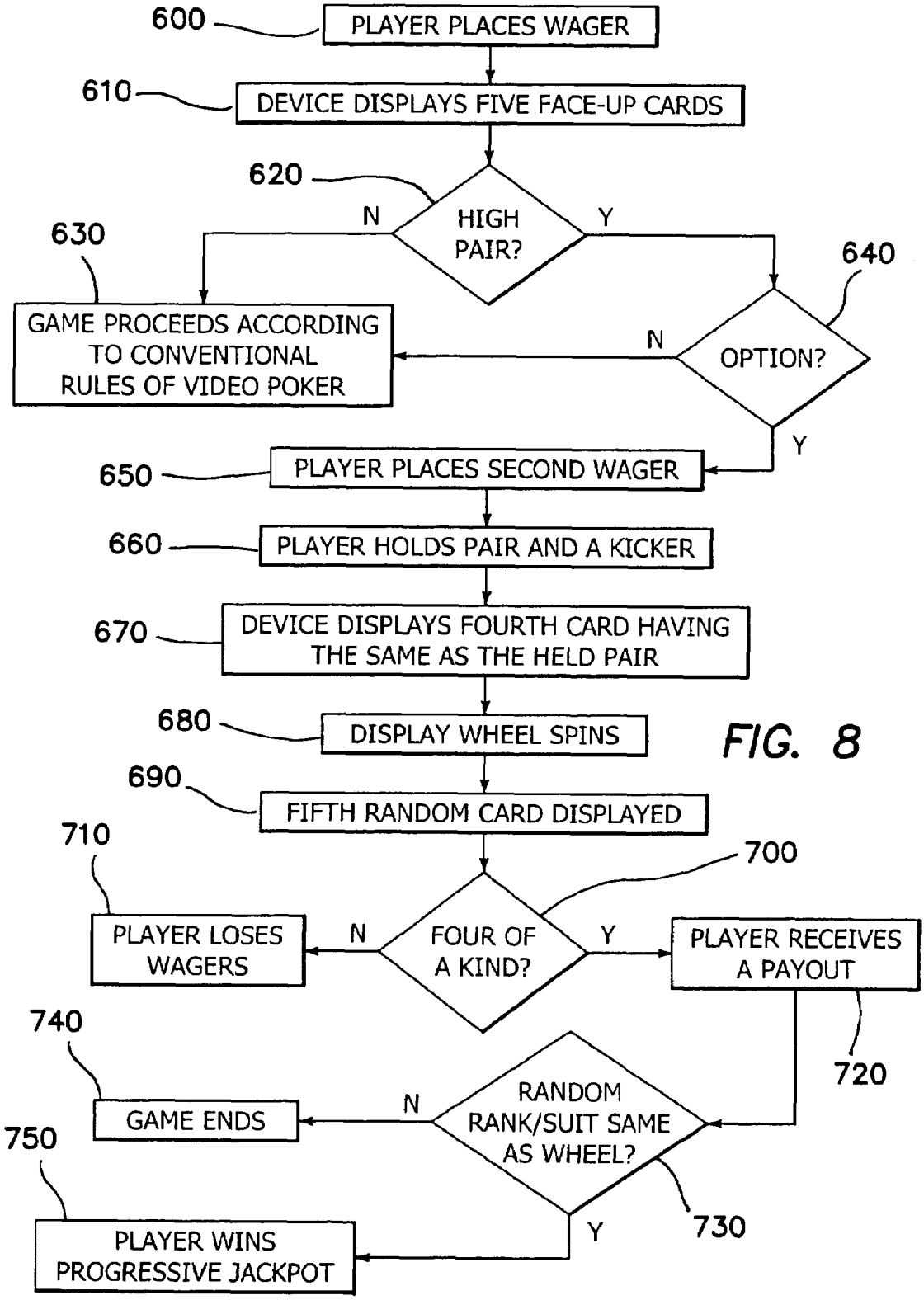
FIG. 8 shows a flow chart detailing the high pair embodiment.

FIG. 8 illustrates a flow chart detailing the steps of the high pair embodiment of the present invention. At step 600, the player places a wager and causes, at step 610, the gaming device to display five face-up cards. At step 620, the gaming device, namely the game processor, determines whether the five dealt cards include a high pair (e.g., a pair of Jacks, Queens, Kings or Aces). If not, at step 630, the game proceeds in a conventional video poker manner. If there is a high pair, at step 640, the player is provided with the option to participate in the high pair game. Should the player elect not to play the high pair embodiment, at step 630, the game proceeds in a conventional video poker manner. Opting to participate, the player may, at step 650, place an additional wager up to nine times the player's original wager. At step 660, the player selects the high pair and kicker to be held. In response to the player selection, at step 670, the gaming device automatically displays a fourth card having the same rank as the rank of the held high pair. The player now holds three of a kind and a kicker. In one embodiment, at step 680, the displayed wheel begins to spin and then, at step 690, the fifth card is randomly drawn and displayed. Once the fifth card has been drawn and displayed, the wheel stops spinning and a pointer 545, or similar feature, identifies one segment of the wheel having a card rank and suit depicted thereon.

The gaming device processor then determines two outcomes. First, at step 700, the device determines whether the fifth card results in a four of a kind. If not, at step 710, the player loses the original wager from step 600 and the added wager from step 650 and the game ends. If the fifth card does result in a four of a kind, at step 720, the player receives a corresponding payout as set forth in more detail in the pay tables of FIGS. 9*a* and 9*b*. Then, at step 730, the device determines whether the rank and suit of the card depicted on the identified wheel segment matches the rank and suit of the kicker. If not, at step 740, the game ends. If there is a match, at step 750, the player wins a progressive jackpot. Ideally, the player must wager the maximum number of units on the original wager and the added wager to win the progressive jackpot. For example, considering a quarter gaming device, the player needs to play the maximum of five quarters on the original wager and nine quarters on the added wager. However, casinos and similar gaming venues will determine the maximum wagers and corresponding wagering schemes.

FIG. 9*a* illustrates a possible pay table 800 for the high pair embodiment. Column 810 represents the amount of the wager 820 and column 830 represents the corresponding payout 840 for receiving four of a kind. FIG. 9*b* illustrates a possible progressive pay table 850. Column 860 represents the wager amount 870, column 880 represents the corresponding payout 890 and column 895 sets forth whether the progressive jackpot is in play. As shown, only the play of maximum units enables the player to participate in the progressive jackpot. In one embodiment, the progressive jackpot associated with the device or multiple devices is funded with six-hundred units. The progressive amount is then incremented with a percentage of each high pair wager until the progressive jackpot is won. Once it is won, the progressive jackpot is funded again with the initial six-hundred units. Progressive jackpots are common in the industry and well-known to those skilled in the art. Ultimately, the funding amount, exact payout values and house edge associated with the progressive jackpot are determined by the casino or gaming venue operating the gaming devices.

Figure 10A:
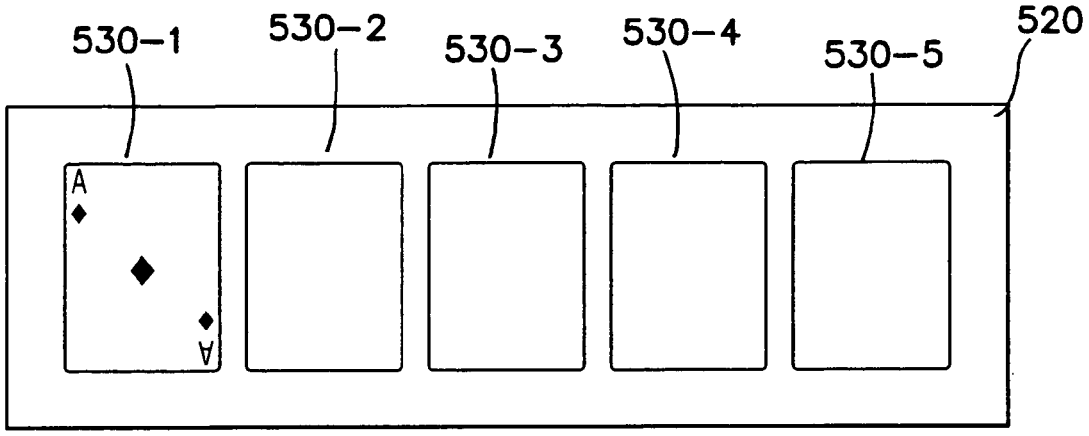
FIG. 10*a* shows a display screen subsequent to a player buying a card in a card in the hole embodiment of the present invention.
Figure 10B:
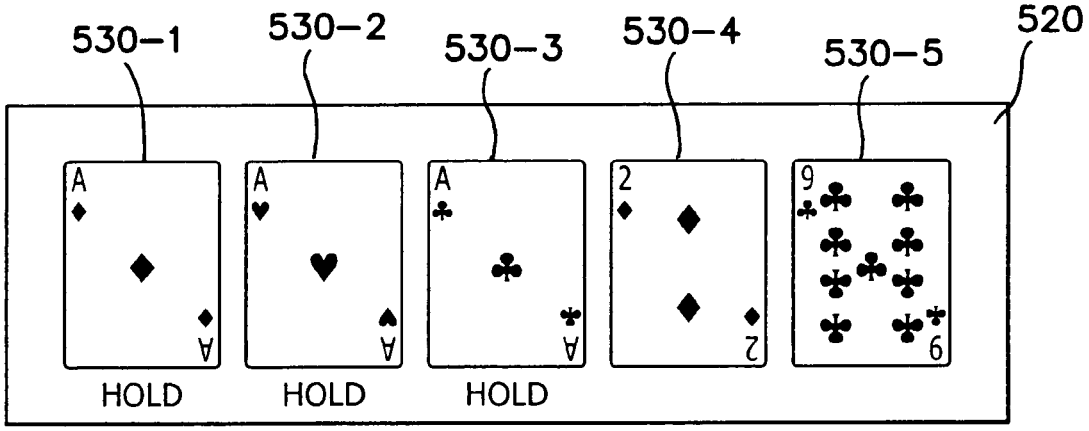
FIG. 10*b* shows the display screen after the player has received four random cards in addition to the Ace.
Figure 10C:
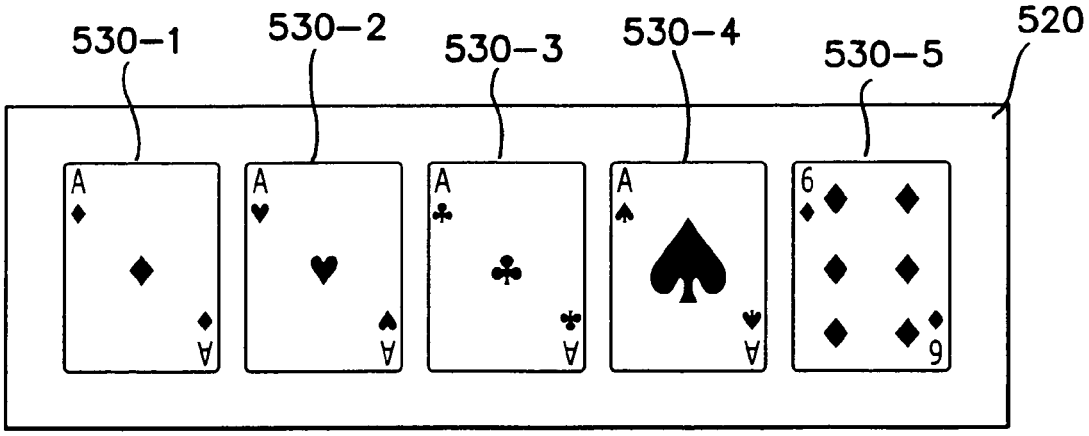
FIG. 10*c* shows the display screen once the player has received replacement cards.

In another embodiment, players are provided the option to buy a card prior to the deal of any cards. In a first embodiment, the player is able to buy an Ace at the outset of the game (i.e., "Hold an Ace" concept). The purchased Ace may be a specific Ace (e.g., the A♠) or may be randomly selected. FIG. 10*a* illustrates the display screen 520 subsequent to the purchase of the Ace 530-1. Then, as shown in FIG. 10*b*, four additional cards 530-2 through 530-5 are randomly selected and displayed from the remaining 51 cards in the deck to form a five card poker hand. In the example shown, the player has received two additional Aces 530-2 and 530-3. The player is now be able to hold and discard any number of the five cards, including the pre-bought Ace 530-1. However, in this case, the player elects to hold the three Aces 530-1 through 530-3. As shown in FIG. 10*c*, the discards are then replaced with cards remaining in the deck to form a final poker hand comprising four Aces.

In general, the player is buying a head start to obtaining certain poker hands. Based on statistics, it has been determined that by purchasing a single Ace, the hit frequency of the Royal Flush doubles and the hit frequency of four Aces triples.

Accordingly, there are several methods, depending on the desired payback, for developing pay tables associated with the embodiment of the present invention whereby players buy a card prior to any cards being dealt. In a first example, players pay a set fee equivalent to a single wager unit (e.g., 0.25¢ on a quarter machine or $1 on a dollar machine). The fee is in addition to the player's initial wager amount. Ideally, the player must play the maximum machine wager to participate in the Hold an Ace embodiment. FIG. 11 shows a conventional video poker pay table 600. FIGS. 12, 13 and 14 illustrate potential Hold the Ace pay tables 610, 620 and 630 with the payouts corresponding to four Aces and Royal Flushes varied. The paybacks for each of the pay tables are in the mid-ninety percent range.

In an alternative embodiment, the fee for buying the Ace is equivalent to the player's initial wager. FIG. 15 illustrates a pay table 640 for conventional video poker in the event the player declines to buy an Ace. FIGS. 16 and 17 illustrate potential pay tables 650 and 660 corresponding to a game wherein the player may discard the purchased Ace and a game wherein the player must retain the purchased Ace, respectively.

It is understood that any number of pay tables are conceivable as long as the payback percentage is acceptable to the gaming venue and not overwhelming on the players.

Thus, although the invention has been described in detail with reference to various embodiments, additional variations and modifications exist within the scope and spirit of the invention as described and defined in the following claims.

I claim:

1. A method of playing a video poker based game comprising:

providing a player an option to buy one or more pre-established non-random specific cards such that a number of bought cards is less than a total number of cards necessary to form a complete poker hand, said option occurring prior to, or during, a game session; and awarding the player one or more payouts based on a rank of a final poker hand.

2. The method of claim 1 wherein the option occurs in response to the player being dealt a pair.

3. The method of claim 2 wherein the option is limited to a pair of jacks, queens, kings or aces.

4. The method of claim 2 wherein if the player accepts the option, the player must hold a kicker in addition to the pair and the player buys a third card having a rank the same as the rank of the pair.

5. The method of claim 4 further comprising generating a random card rank and suit and comparing said random card rank and suit with a rank and suit of the kicker.

6. The method of claim 5 further comprising awarding the player a jackpot based on obtaining a four of a kind in combination with the random card rank and suit matching the rank and suit of the kicker.

7. The method of claim 1 wherein the option occurs before any cards have been dealt.

8. The method of claim 7 wherein if the player accepts the option, the player buys one or more Aces.

9. The method of claim 8 wherein a fee for the one or more Aces is equivalent to a single wager unit.

10. The method of claim 8 wherein a fee for the one or more Aces is equivalent to an initial wager amount.

11. The method of claim 1 wherein the method is facilitated by an electronic gaming device.

12. A method of playing a video poker based wagering game comprising:

dealing a player five or more random cards;

said player holding one or more of the five or more random cards;

if said one or more held cards are common to a pre-established poker hand, providing the player an opportunity to buy one or more non-random specific cards;

if said player elects to buy the one or more cards, replacing one or more of the non-held cards with cards necessary for partial completion of the pre-established poker hand such that the player has a higher probability of successfully drawing the pre-established poker hand after buying the one or more cards than before buying the one or more cards;

randomly replacing each of the player's cards not common to the pre-established poker hand; and awarding said player a payout if the player obtains the pre-established poker hand.

13. The method of claim 12 further comprising the player having to hold a kicker along with the one or more held cards.

14. The method of claim 12 wherein the pre-established poker hand is four of a kind.

15. The method of claim 12 wherein the method is facilitated by an electronic gaming device.

16. A method of playing a video poker based wagering game comprising:

providing five random cards;

if said five random cards include one or more pairs, providing a player an option to place a wager;

if said player elects to place the wager, said player having to hold one pair and one additional dealt card;

providing a fourth card having a rank equal to a rank of the held pair;

providing a random fifth card; and awarding said player a payout if a final poker hand is a four of a kind or a full house.

17. The method of claim 16 further comprising means for randomly generating a card rank and suit for comparison with a rank and suit of the one additional held card.

18. The method of claim 17 wherein the means for randomly generating the single card is a segmented rotatable wheel.

19. The method of claim 18 further comprising paying a jackpot in response to a player obtaining a four of a kind and the randomly generated card rank and suit matching the rank and suit of the additional held card.

20. The method of claim 16 wherein the wager is in a range of one to nine times the amount of an initial wager.

21. The method of claim 16 wherein the pair must equal or rank better than jacks.

22. The method of claim 16 wherein the method is facilitated by an electronic gaming device.

23. A method of playing a video poker based wagering game comprising:

dealing five random cards;

if said five random cards include one or more pairs, providing a player an option to buy a card;

if said player elects to buy a card, said player having to hold a pair and a kicker;

providing the bought card, said bought card having a rank the same as a rank of the held pair;

providing a random fifth card; and awarding said player a payout if the player's final poker hand is a four of a kind or a full house.

24. The method of claim 23 further comprising means for randomly generating a card rank and suit for comparison with a rank and suit of the kicker.

25. The method of claim 24 wherein the means for randomly generating the card rank and suit is a segmented wheel.

26. The method of claim 24 further comprising paying a jackpot in response to a player obtaining a four of a kind and the randomly generated card rank and suit matching the rank and suit of the kicker.

27. The method of claim 23 wherein the wager is one to nine times the amount of an initial total wager.

28. The method of claim 23 wherein the held pair must equal or rank better than jacks.

29. The method of claim 23 wherein the method is facilitated by an electronic gaming device.

30. A method of playing a video poker based wagering game comprising:

providing five random cards;

if said five random cards include one or more pairs equal to or better than jacks, providing the player an option to place a wager;

if said player elects to place the wager, said player having to hold one pair equal to or better than jacks and one additional dealt card;

providing a fourth card having a rank equal to a rank of the held pair;

providing a random fifth card and generating a random card rank and suit;

comparing the random card rank and suit to the one additional held card;

awarding said player a first payout if the player's final poker hand comprises four of a kind or a full house; and awarding said player a second payout if the player's final poker hand comprises a four of a kind and the random card rank and suit matches a rank and suit of the one additional held card.

31. The method of claim 30 wherein generating a random card rank and suit is accomplished by a spinning segmented wheel, each segment depicting a card rank and suit.

32. The method of claim 30 wherein the second payout is associated with a progressive jackpot.

33. A gaming device comprising:

a processor in communication with a random number generator and display;

one or more player interfaces;

said random number generator for generating a display of five random cards;

said one or more player interfaces allowing a player to hold one or more of the five displayed random cards such that if said five displayed cards include one or more pairs, said processor providing the player an opportunity to place a wager;

if said player elects to place the wager, said player having to hold one of the pairs and one additional card and said processor causing a fourth card of the same rank as the pair to be displayed;

said processor causing a randomly generated fifth card to be displayed; and said processor awarding said player a payout if the player's final poker hand is a four of a kind or a full house.

34. The gaming device of claim 33 further comprising the random number generator generating a card rank and suit for comparison with a rank and suit of the one additional held card.

35. The gaming device of claim 34 wherein the card rank and suit is displayed on said display.

36. The gaming device of claim 34 wherein the card rank and suit of each card in a standard deck of cards appears on a segmented wheel displayed by said display.

37. The gaming device of claim 34 wherein the processor causes a payout in response to the player receiving a four of a kind and the randomly generated card rank and suit matching the rank and suit of the one additional held card.

* * * * *